US006019717A

United States Patent [19]

Herman

[11] Patent Number: 6,019,717

[45] Date of Patent: Feb. 1, 2000

[54] NOZZLE INLET ENHANCEMENT FOR A HIGH SPEED TURBINE-DRIVEN CENTRIFUGE

[75] Inventor: Peter K. Herman, Cookeville, Tenn.

[73] Assignee: Fleetguard, Inc., Nashville, Tenn.

[21] Appl. No.: 09/209,570

[22] Filed: Dec. 11, 1998

Related U.S. Application Data

[63] Continuation-in-part of application No. 09/136,736, Aug. 19, 1998.

[51] Int. Cl.[7] ..... B04B 9/06; B04B 1/08

[52] U.S. Cl. ..... 494/49; 494/70; 210/168; 210/380.1

[58] Field of Search ..... 494/24, 36, 43, 494/49, 64, 65, 68, 70, 83, 901; 210/168, 171, 232, 354, 360.1, 380.1, 416.5; 184/6.24

[56] References Cited

U.S. PATENT DOCUMENTS

| | | | |
|---|---|---|---|
| 2,053,856 | 9/1936 | Weidenbacker . | |
| 2,321,144 | 6/1943 | Jones | 494/49 |
| 2,335,420 | 11/1943 | Jones | 494/49 |
| 2,485,390 | 10/1949 | Langmuir | 494/49 |
| 3,273,324 | 9/1966 | Jennings | 494/49 |
| 3,432,091 | 3/1969 | Beazley | 494/49 |
| 3,784,092 | 1/1974 | Gibson | 494/49 |
| 4,106,689 | 8/1978 | Kozulla . | |
| 4,221,323 | 9/1980 | Courtot . | |
| 4,284,504 | 8/1981 | Alexander et al. | 210/168 |
| 4,288,030 | 9/1981 | Beazley et al. | 210/360.1 |
| 4,346,009 | 8/1982 | Alexander et al. . | |
| 4,400,167 | 8/1983 | Beazley et al. | 210/360.1 |
| 4,431,540 | 2/1984 | Budzich . | |
| 4,498,898 | 2/1985 | Haggett | 494/49 |
| 4,557,831 | 12/1985 | Lindsay et al. | 494/49 |
| 4,615,315 | 10/1986 | Graham | 184/6.24 |
| 4,787,975 | 11/1988 | Purvey | 494/49 |
| 5,096,581 | 3/1992 | Purvey | 494/49 |
| 5,169,065 | 12/1992 | Bloch . | |
| 5,213,260 | 5/1993 | Tonkinson . | |
| 5,575,912 | 11/1996 | Herman et al. | 494/70 |
| 5,637,217 | 6/1997 | Herman et al. . | |
| 5,674,392 | 10/1997 | Christophe et al. | 494/49 |
| 5,707,519 | 1/1998 | Miller et al. | 494/49 |
| 5,779,618 | 7/1998 | Onodera et al. | 494/901 |

FOREIGN PATENT DOCUMENTS

| | | | |
|---|---|---|---|
| 145089 | 1/1962 | U.S.S.R. | 494/49 |
| 362643 | 12/1972 | U.S.S.R. | 494/49 |
| 564884 | 7/1977 | U.S.S.R. | 494/49 |
| 633609 | 11/1978 | U.S.S.R. . | |
| 869822 | 10/1981 | U.S.S.R. | 494/49 |

*Primary Examiner*—Charles E. Cooley
*Attorney, Agent, or Firm*—Woodard, Emhardt, Naughton Moriarty & McNett Patent and Trademark Attorneys

[57] ABSTRACT

A cone-stack centrifuge for separating particulate matter out of a circulating liquid includes a cone-stack assembly which is configured with a hollow rotor hub and is constructed to rotate about an axis. The cone-stack assembly is mounted onto a shaft centertube which is attached to a hollow base hub of a base assembly. The base assembly further includes a liquid inlet, a first passageway, and a second passageway which is connected to the first passageway. The liquid inlet is connected to the hollow base hub by the first passageway. A bearing arrangement is positioned between the rotor hub and the shaft centertube for rotary motion of the cone-stack assembly. An impulse-turbine wheel is attached to the rotor hub and a flow jet nozzle is positioned so as to be directed at the turbine wheel. The flow jet nozzle is coupled to the second passageway for directing a flow jet of liquid at the turbine wheel in order to impart rotary motion to the cone-stack assembly. The liquid for the flow jet nozzle enters the cone-stack centrifuge by way of the liquid inlet. The same liquid inlet also provides the liquid which is circulated through the cone-stack assembly. A honeycomb-like insert is assembled into the flow jet nozzle in order to reduce inlet turbulence and improve the turbine efficiency.

5 Claims, 9 Drawing Sheets

NOZZLE INLET ENHANCEMENT FOR A HIGH SPEED TURBINE-DRIVEN CENTRIFUGE

REFERENCE TO RELATED APPLICATION

This application is a continuation-in-part of patent application Ser. No. 09/136,736, filed Aug. 19, 1998, Peter K. Herman, inventor, entitled HIGH PERFORMANCE SOOT REMOVING CENTRIFUGE, now pending.

BACKGROUND OF THE INVENTION

The present invention relates generally to the continuous separation of solid particles, such as soot, from a fluid, such as oil, by the use of a centrifugal field. More particularly the present invention relates to the use of a cone (disk) stack centrifuge configuration within a centrifuge assembly which includes a turbine wheel for rotatably driving a rotor. The turbine wheel is driven by jet nozzles tangentially aligned with the runner circular centerline.

Diesel engines are designed with relatively sophisticated air and fuel filters (cleaners) in an effort to keep dirt and debris out of the engine. Even with these air and fuel cleaners, dirt and debris, including engine-generated wear debris, will find a way into the lubricating oil of the engine. The result is wear on critical engine components and if this condition is left unsolved or not remedied, engine failure. For this reason, many engines are designed with fill flow oil filters that continually clean the oil as it circulates between the lubricant sump and engine parts.

There are a number of design constraints and considerations for such full flow filters and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try and address the concern over small particles, designers have gone to bypass filtering systems which filter a predetermined percentage of the total oil flow. The combination of a full flow filter in conjunction with a bypass filter reduces engine wear to an acceptable level, but not to the desired level. Since bypass filters may be able to trap particles less than approximately 10 microns, the combination of a full flow filter and bypass filter offers a substantial improvement over the use of only a full flow filter.

While centrifuge cleaners can be configured in a variety of ways as represented by the earlier designs of others, one product which is representative of part of the early design evolution is the Spinner II® oil cleaning centrifuge made by Glacier Metal Company Ltd., of Somerset, Ilminister, United Kingdom, and offered by T. F. Hudgins, Incorporated, of Houston, Tex. Various advances and improvements to the Spinner II® product are represented by U.S. Pat. No. 5,575,912 issued Nov. 19, 1996 to Herman and by U.S. Pat. No. 5,637,217 issued Jun. 10, 1997 to Herman and these two patents are expressly incorporated by reference herein for their entire disclosures.

There is currently an engine operation phenomenon taking place which creates unacceptable levels of lube-oil soot. A majority of this lube-oil soot needs to be removed from the circulating oil due to the abrasive nature of the soot and the corresponding risk of unacceptable wear on critical engine surfaces and at critical engine interfaces. Increasingly stringent $NO_x$ emissions regulations are causing widespread usage of retarded injection and in some cases exhaust gas recirculation or water injection to further retard the combustion event. In turn, this reduces peak temperatures and causes $NO_x$ formation. However, delayed combustion allows soot deposition on exposed cylinder walls and subsequent transfer to the lube oil by the scraping of the rings. Engine data derived to examine lube-oil soot has revealed levels as high as seven percent (7%) in 250 hours of operation. While this lube-oil soot has a relative diminutive size on the order of 0.02 to 0.06 microns, it is still abrasive in nature and capable of causing wear at critical high pressure/load interfaces such as those found in valve train components. For additional information regarding the abrasive nature and wear, refer to SAE Paper No. 971631.

Of importance with regard to the present invention is the realization that removal of the extremely small soot particles by way of conventional filtration or by means of conventional centrifugal separators, including cone-stack designs, has generally proven to be fruitless. One of the limiting factors is the rotational speed that centrifugal separators are typically driven at. The typical or normal rotational speed for Hero- turbine centrifugal separators is in the range of approximately 5000 RPMs for a rotor with a 4.75 inch outside diameter cone stack and approximately 7000 RPMs for a rotor with a 3.50 inch outside diameter cone stack. These speeds are not fast enough to remove the soot at an adequate rate in order to control soot build up in the oil. Rates of approximately twice those listed are needed to effectively attack the soot build-up problem.

The oil in the sump begins as clean oil and, over time with operation of the engine, soot gradually builds up. The objective is to control the percentage of soot in the sump oil. While an equilibrium condition will, in time, be established where the removal rate is the same as the add rate, the key is the percentage of soot. The governing equation is the following:

$$\text{Equilibrium soot concentration} = \frac{\text{add rate}}{(\text{centrifuge removal efficiency})(\text{centrifuge flow rate})}$$

The removal efficiency and the flow rate are coupled such that just doubling the flow rate cuts the efficiency by one-half. The key is the removal efficiency. If this can be increased, the soot concentration in the sump will be decreased without altering any other factors or components.

In view of the discussed concerns and issues with regard to present centrifugal separator designs, it would be an improvement to devise a configuration suitable to generate a faster drive (rotational) speed. Testing has shown that by driving a centrifugal separator at a rotational speed closer to 10,000 RPMs, it is possible to demonstrate drastic soot reduction from an approximate 4.1 percent level to an approximate 0.8 percent level in the lubricant fluid in 280 hours of sump circulation (off-engine testing). The present invention provides an improved structure for a cone-stack centrifugal separator which is capable of generating the desired 10,000 RPM speed without needing to increase the lube system pressure above the normal and desired operating pressure of 70 PSI. The operating pressure range is from approximately 40 PSI to an upper limit of approximately 90 PSI.

One concern with this range of pressure is that the bearings which support the rotor need to be designed to withstand and contain the pressure inside the rotor. While journal bearings are preferred for these elevated pressure levels, these bearings have a rotational drag coefficient, caused by viscous shear of thin oil film between bearing and shaft, which precludes the cone-stack centrifuge from being driven at the desired 10,000 RPM (or higher) speed. By reducing the operating pressure inside the centrifuge rotor, roller bearings are able to be used which have a substantially lower drag coefficient, allowing a higher speed of rotation.

SUMMARY OF THE INVENTION

A cone-stack centrifuge for separating particulate matter out of a circulating fluid according to one embodiment of the present invention comprises a cone-stack assembly including a hollow rotor hub and being designed to rotate about an axis, a base assembly which defines a liquid inlet, a first passageway, a second passageway connected to the first passageway and a hollow base hub, the liquid inlet being connected to the hollow base hub by the first shaft passageway, a shaft centertube attached to the base hub and extending through the rotor hub, a bearing positioned between the rotor hub and the shaft centertube for rotary motion of the cone-stack assembly, a turbine wheel attached to the rotor hub, and a flow jet nozzle flow coupled to the second passageway for directing a flow jet of liquid at the turbine wheel in order to drive the turbine wheel which in turn imparts rotary motion to the cone-stack assembly. A related embodiment of the present invention includes the use of a honeycomb-like insert assembled into the inlet of the flow jet nozzle in order to reduce inlet turbulence and improve the turbine efficiency.

One object of the present invention is to provide an improved cone-stack centrifuge.

Related objects and advantages of the present invention will be apparent from the following description.

DESCRIPTION OF THE PREFERRED EMBODIMENT

Figure 1:
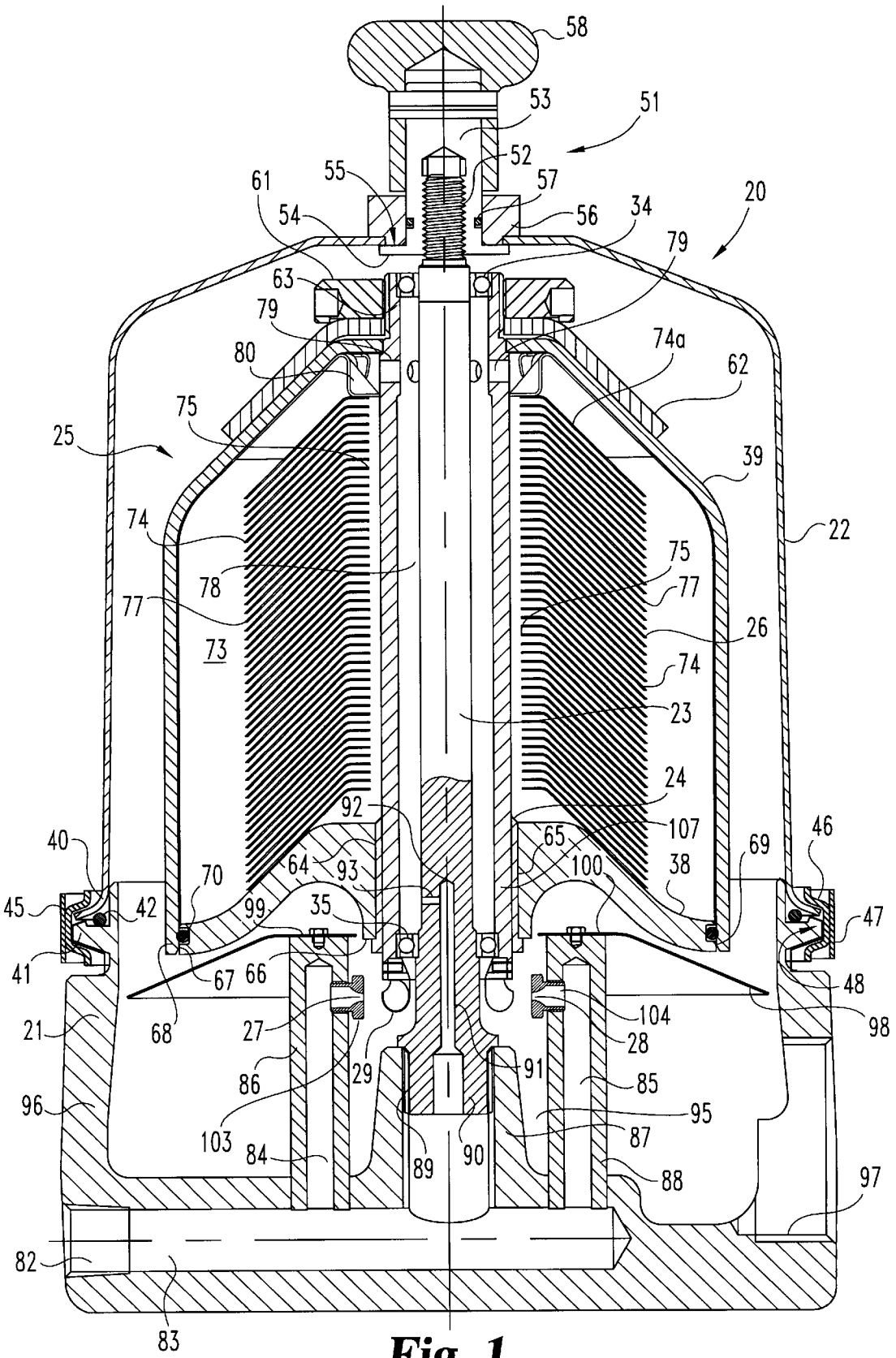
FIG. 1 is a front elevational view in full section of a cone-stack centrifuge according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a cone-stack centrifuge 20 according to a preferred embodiment of the present invention. Centrifuge 20 includes as some of its primary components base 21, bell housing 22, shaft 23, rotor hub 24, rotor 25, cone stack 26, jet nozzles 27 and 28, and modified Pelton turbine 29. As described and used herein, the rotor 25 includes a cone-stack assembly.

Figure 2:
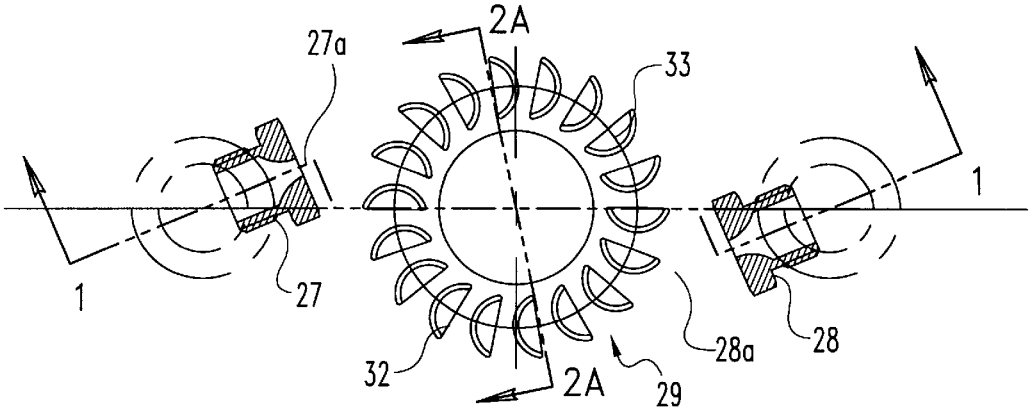
FIG. 2 is a diagrammatic top plan view of a impulse turbine and cooperating jet nozzles which comprise part of the FIG. 1 cone-stack centrifuge.

FIG. 2 provides a diagrammatic top plan view of jet nozzles 27 and 28 as well as impulse turbine 29 showing the direction of the flow jets 27*a* and 28*a* exiting from jet nozzles 27 and 28, respectively. Turbine 29 includes a circumferential series of eighteen buckets 32 attached to a rotatable wheel 33. The flow jets 27*a* and 28*a* are directed tangentially to the wheel on opposite sides of the wheel, and are aimed at the center of the buckets which rotate into the tangency zone on the corresponding side of wheel 33. Rotatable wheel 33 is securely and rigidly attached to rotor hub 24 which is concentrically positioned around shaft 23. The rotor hub is bearingly mounted to and supported by shaft 23 by means of upper roller bearing 34 and lower roller bearing 35. Sealed bearings are used as opposed to shielded bearings in order to reduce bearing leakage flow.

Figure 1A:
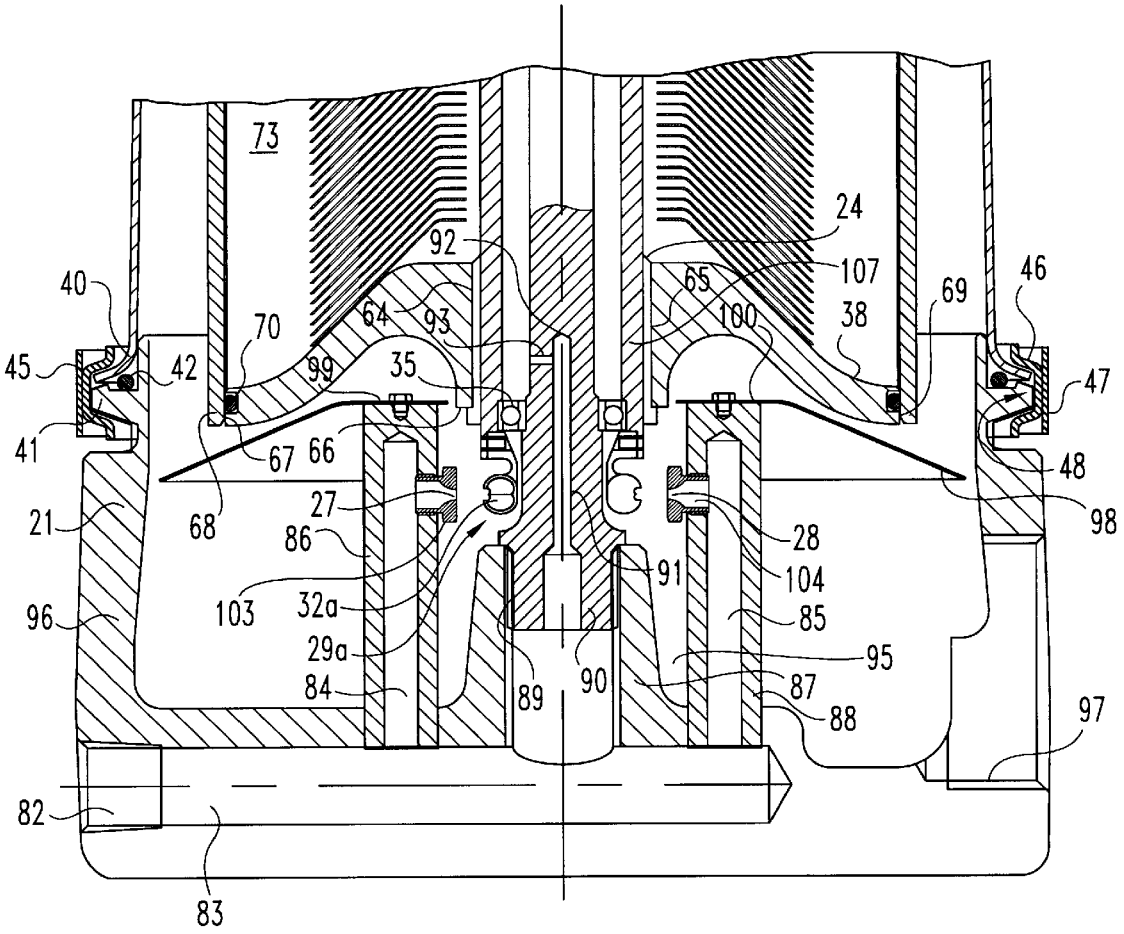
FIG. 1A is a partial front elevational view in full section of a cone-stack centrifuge according to another embodiment of the present invention.
Figure 2A:
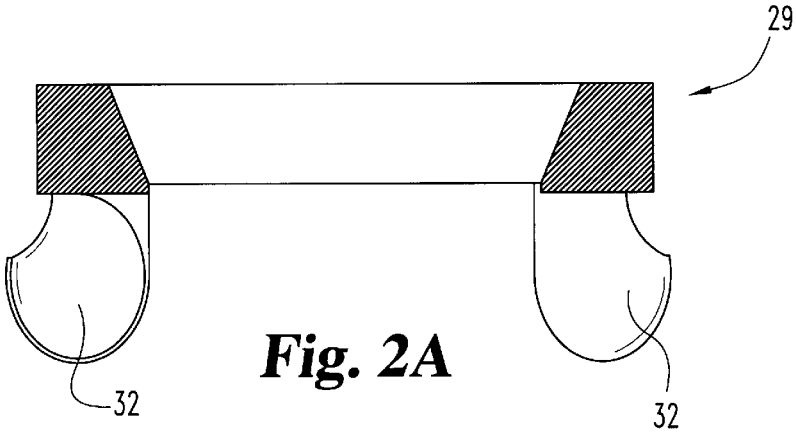
FIG. 2A is a front elevational view in full section of a modified half-bucket for use as part of the FIG. 2 impulse turbine which is used in the FIG. 1 cone-stack centrifuge.
Figure 2B:
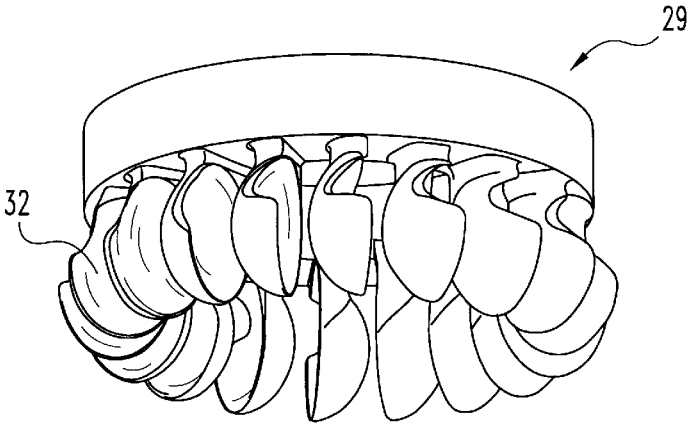
FIG. 2B is a perspective view of the FIG. 2A modified half-bucket.

While turbine 29 can be configured in a variety of styles, the preferred configuration for the present invention is a modified half-bucket style of Pelton turbine. The modified half-bucket turbine 29 is illustrated in FIG. 1 while a conventional Pelton turbine 29*a* (split-bucket) is illustrated in FIG. 1A. The differences between these two turbine options are effectively limited to the geometry of the buckets, 32 and 32*a*, respectively. With the exception of replacing the modified half-bucket style of turbine 29 in FIG. 1 with the split-bucket style of turbine 29*a* in FIG. 1A, the construction of the FIG. 1 and FIG. 1A centrifuges are identical. While the construction of a split-bucket 32*a* is believed to be well known, the modified half-bucket 32 configuration is unique to this application. Reference to FIGS. 2A and 2B will provide additional details regarding the geometry and construction of each half-bucket 32.

The cone-stack assembly or rotor 25 is defined herein as including as its primary components base plate 38, vessel shell 39, and cone stack 26. The assembly of these primary components is attached to rotor hub 24 such that as rotor hub 24 rotates around shaft 23 by means of roller bearings 34 and 35, the rotor 25 rotates. The rotary motion imparted to rotor hub 24 comes from the action of turbine 29 which is driven by the high pressure flow out of jet nozzles 27 and 28. As the flow jets 27*a* and 28*a* impinge on the buckets 32, each corresponding bucket is pushed, rotating the wheel 33 so as to bring the next sequential bucket into position for the point of tangency striking by the flow jets. This procedure occurs on each side of the wheel in a cooperating manner as the points of tangency for flow jets 27*a* and 28*a* are 180 degrees apart. The wheel rotates faster and faster until a steady state speed of rotation is achieved based on the characteristics of the flow jets 27*a* and 28*a* and the characteristics and dynamics of the turbine. Since the turbine is attached to the rotor hub 24 which is bearingly mounted on the shaft 23, the rotor 25 rotates at a RPM speed which corresponds to the speed of the wheel 33 of the turbine 29.

In the preferred embodiment of turbine 29, each bucket 32 (the modified half-bucket style) has an ellipsoidal profile and a 10 to 15 degree exit angle on the edge of the ellipsoid. A front elevational view of one bucket 32 is illustrated in FIG. 2A. A perspective view of one bucket 32 is illustrated in FIG. 2B. The flow exiting from the bucket is directed downward and away from the spinning rotor, thus reducing droplet impingement drag.

Except for those portions within base 21 and below base plate 38, the structure of centrifuge 20 is similar in certain respects to the structure disclosed in U.S. Pat. Nos. 5,575,912 and 5,637,217, which patents have been expressly incorporated by reference herein. More specifically, the outer radial lip 40 of the bell housing 22 is positioned on the upper surface of flange 41. The interface between radial lip 40 and flange 41 is sealed in part by the addition of an intermediate annular, rubber O-ring 42. A band clamp 45 is used to complete and complement the sealed interface. Clamp 45 is positioned around the lip 40 and flange 41 and includes an inner annular clamp 46 and an outer annular band 47. As the band 47 is drawn tight, the clamp inside diameter is reduced and the tapered sides of annular channel 48 pull the lip 40 and flange 41 together axially into a tightly sealed interface. The drawing together of the lip 40 and flange 41 compresses the O-ring 42.

Figure 3:
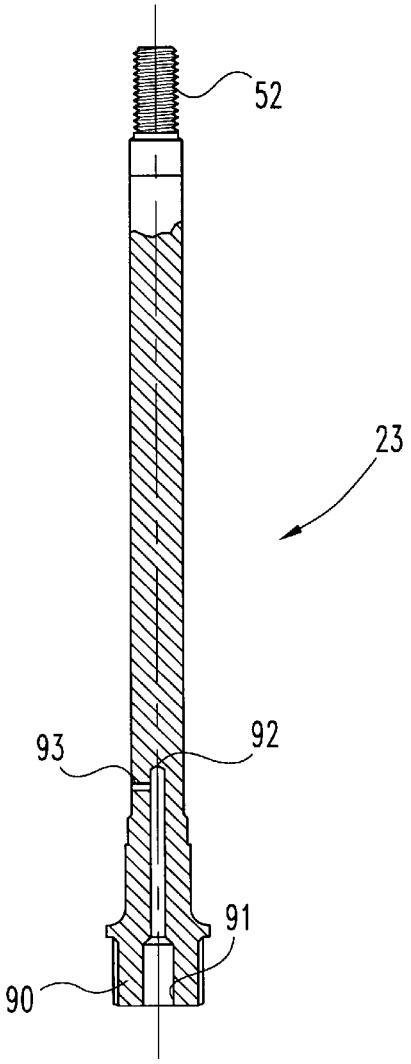
FIG. 3 is a front elevational view in full section of a center shaft which comprises one part of the FIG. 1 cone-stack centrifuge.

At the top of bell housing 22, a cap assembly 51 is provided for receipt and support of the externally-threaded end 52 of shaft 23. The details of shaft 23 are illustrated in FIG. 3. Adapter 53 is internally threaded and includes a flange 54 that fits through and up against the edge of opening 55. Sleeve 56, O-ring 57, and cap 58 complete the assembly. With the end 52 first threaded into adapter 53, and with the O-ring assembled, the housing and sleeve are then lowered into position. The cap is attached to secure the cap assembly 51 to the shaft 23 and housing 22 and the band clamp assembled and tightened into position. Cap assembly 51 provides axial centering for the upper end 52 of shaft 23 and for the support and stabilizing of shaft 23 in order to enable smooth and high speed rotation of rotor 25.

Figure 4:
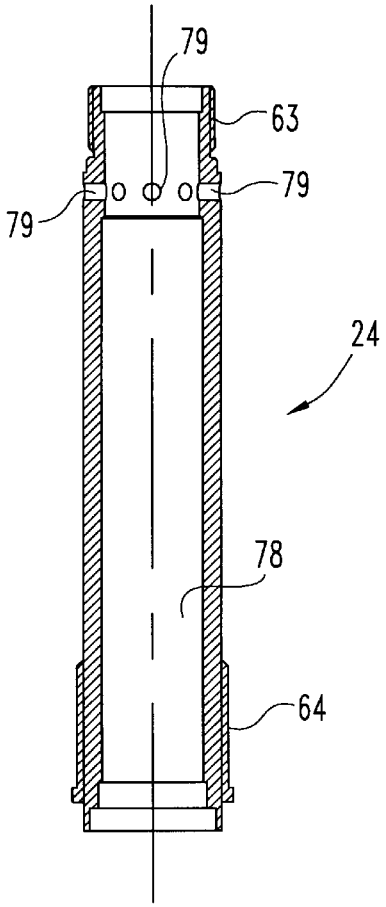
FIG. 4 is a front elevational view in full section of a rotor hub which comprises one part of the FIG. 1 cone-stack centrifuge.
Figure 5:
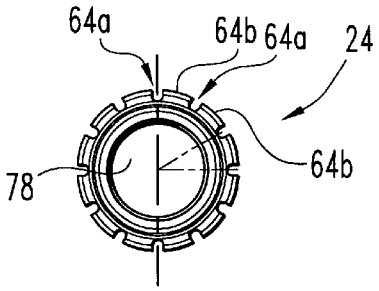
FIG. 5 is a top plan view of the FIG. 4 rotor hub.

Disposed at the upper end of the rotor 25, between the bell housing 22 and the externally-threaded end 52, is an attachment nut 61 and support washer 62. The annular support washer has a contoured shaped which corresponds to the shape of the upper portion of rotor shell 39. An alternative envisioned for the present invention in lieu of a separate component for washer 62 is to integrate the support washer function into the rotor shell by fabricating an impact extruded shell with a thick section at the washer location. Upper end 63 of rotor hub 24 is bearingly supported by shaft 23 and upper bearing 34 and is externally threaded. Attachment nut 61 is threadedly tightened onto upper end 63 and this draws the support washer 62 and rotor shell 39 together. The opposite (lower) end 64 of rotor hub 24 is configured with a series of axial notches 64*a* and an alternating series of outwardly extending splines 64*b* (see FIGS. 4 and 5). This splined end fits tightly within the cylindrical aperture 65 which is centered in base plate 38. Aperture 65 is concentric with hub 24 and with shaft 23 and the anchoring of the hub to the housing and to the base plate ensures a concentric rotation of the cone-stack assembly around the shaft 23. The fit between the splined end 64 and aperture 65 also creates a series of spaced-apart, exiting flow channels 66 by way of the notches 64*a* and splines 64*b*.

A radial seal is established between the inner surface 67 of lower edge 68 of rotor shell 39 and the outer annular surface 69 of base plate 38. This sealed interface is determined in part by the closeness of the fit and in part by the use of annular, rubber O-ring 70. O-ring 70 is compressed between the inner surface 67 and the outer annular surface 69.

The assembly between the rotor shell 39 and base plate 38 in combination with O-ring 70 creates a sealed enclosure defining an interior volume 73 which contains cone stack 26. Each cone 74 of the cone stack 26 has a center opening 75 and a plurality of inlet holes disposed around the circumference of the cone adjacent the outer annular edge 77. Typical cones for this application are illustrated and disclosed in U.S. Pat. Nos. 5,575,912 and 5,637,217. The typical flow path for the rotor 25 begins with the flow of liquid upwardly through the hollow center 78 of rotor hub 24. The flow through the interior of the rotor hub exits out through apertures 79. A total of eight equally-spaced apertures 79 are provided, see FIG. 4. A flow distribution plate 80 is configured with vanes and used to distribute the exiting flow out of hub 24 across the surface of the top cone 74*a*. The manner in which the liquid (lubricating oil) flows across and through the individual cones 74 of the cone stack 26 is a flow path and flow phenomenon which is well known in the art. This flow path and the high RPM spinning rate of the cone-stack assembly enables the small particles of soot which are carried by the oil to be centrifugally separated out of the oil and held in the centrifuge.

The focus of the present invention is on the design of base 21, the use of a turbine 29, the manner of routing a fluid to the flow jet nozzles 27 and 28, and the configuration of shaft 23 which provides the desired design compatibility with the base 21, turbine 29, and nozzles 27 and 28. The base 21 is configured with and defines an inlet aperture 82 and main passageway 83. Intersecting main passageway 83 at right angles are jet nozzle passageways 84 and 85. Passageway 84 is defined by mounting post 86 and provides a fluid communication path to jet nozzle 27. On the opposite side of wheel 33 and on the opposite side of base hub 87 for mounting post 86 is a second mounting post 88 which defines passageway 85. Passageway 85 provides a fluid communication path to jet nozzle 28. The hub 87 of base 21 includes a cylindrical aperture 89 which is internally threaded and which intersects main passageway 83 at a right angle. The base 90 of shaft 23 is externally threaded and threadedly secured and assembled into aperture 89. Base 90 is hollow and defines passageway 91, which has a blind distal end 92 and throttle passageway 93. The distal end of passageway 83 is closed (i.e., blind) as is the distal end of passageway 84 and the distal end of passageway 85.

The fit of splined end 64 of rotor hub 24 into cylindrical aperture 65 supports the rotor hub 24 within base plate 38 and maintains the securely assembled status between base plate 38, rotor shell 39, and rotor hub 24. A press fit or even a tight fit between end 64 and aperture 65 is sufficient for the desired support. The splined fit between end 64 and aperture 65 is also designed to prevent relative rotational movement between the rotor hub 24 and base plate 38. The fit of end 64 within aperture 65 creates exiting flow channels 66 which open into the interior space 95 of base 21 defined by the side wall 96 of base 21. Side wall 96 further defines outlet drain opening 97 which permits the oil exiting from the rotor 25 by way of flow channel 66 to drain out from base 21 and continue on its circulatory path to and through the corresponding engine, or other item of equipment. The lubricating oil which is used through the jet nozzles 27 and 28 to drive the turbine 29 also accumulates in interior space 95 and combines with the oil exiting through flow channel 66 and it is this blended oil which exits through the outlet drain opening 97. Splash plate 98 is attached to the upper end surface 99 and 100 of posts 86 and 88, respectively.

For the operation of the centrifuge 20 as illustrated in FIG. 1, pressurized (20–90 PSI) fluid flow (oil) enters the centrifuge base 21 via inlet aperture 82 and main passageway 83. Pressurized oil is supplied to passageways 84 and 85 as well as to passageway 91 by way of cylindrical aperture 89. Post 86 defines an exit orifice 103 which flow connects with jet nozzle 27. A similar exit orifice 104 is defined by post 88 and flow connects with jet nozzle 28. The blind nature of passageways 84 and 85 forces the entering flow out through orifices 103 and 104 in order to create flow jets 27*a* and 28*a* which drive the turbine 29 which in turn rotatably drives rotor hub 24 and the remainder of rotor 25. The high velocity streams of fluid exiting from the two flow jet nozzles create the necessary high RPM speed for the rotor 25 in order to achieve the desired soot removal rate from the oil being routed through the rotor 25. The requisite speed is a function of the outside diameter size of the cone stack as previously discussed.

In the preferred embodiment, jet nozzles 27 and 28 each have an exit orifice sized at a diameter of approximately 2.46 mm (0.09 inches). Each nozzle has a tapered design on the interior so as to create a smooth transition leading to the exit orifice diameter in order to develop a coherent stable jet with minimal turbulent energy and maximum possible velocity. The turbine 29 converts the kinetic energy of the jets to torque which is imparted to the rotor hub 24. As has been described, various styles or designs for turbine 29 are contemplated within the scope and teachings of the present invention, including a classic Pelton turbine, though miniaturized in size, a modified half-bucket style, and a vane-ring or "turgo" style. Of these options, the modified half-bucket style is the preferred choice. The turbine is optimized in performance efficiency when the bucket velocity is slightly less than one-half that of the impinging flow jet velocity. In an ideal design, the driving fluid "drops off" the bucket with nearly zero residual velocity and falls down into the interior space 95 of the base and exits by way of drain opening 97. A target speed of 10,000 RPMs with a 70 PSI jet, a design for turbine 29 with a bucket pitch diameter of 28.96 mm (1.14 inches), and a delivery torque of approximately 1 inch/pound are characteristics of the design of the preferred embodiment. Under these specifications, the pumping horsepower (parasitic) loss to the engine is only 0.2 HP (less than 0.03 percent of engine output for the size of engine under study for these conditions).

The entering oil by way of passageway 83 also flows up through cylindrical aperture 89 into passageway 91 of shaft 23. The upward flow exits the interior of shaft 23 by way of throttle passageway 93. In the preferred embodiment, the exit orifice diameter for passageway 93 is 1.85 mm (0.073 inches) which limits the flow rate through the rotor 25 to approximately 0.6 gallons per minute. Under test it has been learned that there is a high-torque drag spike when flow is between 0.2 and 0.4 gallons per minute through the rotor. A flow of 0.6 gallons per minute avoids this problem. A critical aspect of the present invention is the throttling of the incoming flow by the use of passageway 93 which is located adjacent to the inlet end 107 of the rotor hub 24. In the illustration of FIG. 1, the rotor hub 24 extends in an upward direction from base 21 and base plate 38 to the area of the attachment nut 61 at the upper end or top of the vessel shell 39. Since the incoming oil enters at aperture 82 and from there flows in and up, the lower end 107 of the rotor hub is the inlet end for the purpose of defining the flow path.

Locating the throttle passageway 93 at the inlet end 107 of the rotor hub in effect depressurizes the interior 78 of the rotor hub 24 and this permits the use of standard deep-groove sealed roller bearings at the locations of upper roller bearing 34 and at lower roller bearing 35. The use of these styles of roller bearings dramatically reduces the rotational drag compared to the prior art (old style) journal bearings. At higher internal pressures within the interior 78 of rotor hub 24 than what is present with the present invention due to the throttling effect, journal bearings are needed since they can withstand the higher pressure. The problem is that journal bearings have substantial levels of rotational drag which limit the RPM speed which can be achieved for the rotor 25. The resulting soot removal efficiency drops off substantially, resulting in a noticeably less efficient design and arguably an unacceptable design, if control of soot is the objective. There is a domino effect by throttling the flow and reducing the interior pressure in interior 78. The ability to use roller bearings in the centrifuge design according to the present invention permits higher rotational speeds due to the lower drag and thus speeds in the range of 10,000 RPMs (and higher) can be achieved with the present invention. It has been determined that speeds in this range are required for efficient soot removal.

After exiting the shaft throttle passageway 93, the process fluid (oil) travels upwardly in the hollow center or interior 78 of rotor hub 24 between the shaft 23 and hub 24. Near the upper portion of hub 24, there are a plurality of outlet holes, eight total in the preferred embodiment. The flowing oil passes through each of these outlet holes 79 and the flow is directed up and around the cone stack by a flow distribution plate which is equipped with radial vanes that accelerate the fluid in the tangential direction.

The flow is distributed throughout the cone stack through the vertically-aligned cone inlet holes and flows through the gaps in the cone stack radially inwards toward the hub. The stack of cones is rigidly supported by the rotor hub base plate. Upon reaching the hub outside diameter, the flow passes down through aligned cut outs on the inside diameter of the cones and exits the interior volume 73 through the flow channels 66. As an alternative to this configuration, the base plate 38 can be a one-piece design with holes drilled through the plate for fluid exit paths. It is important that the flow exits from the flow channels 66 as near the rotational axis as possible to avoid drag/speed reduction due to centrifugal "pumping" energy loss by dumping flow out at a high tangential velocity, which increases proportionately with radius. Also, the exiting flow must leave the cone-stack assembly in a manner such that it does not contact the outside surface of the base plate and, as a result, rob energy by being re-accelerated and "slung" from the outside diameter of the rotor base at a high speed. This result is achieved by routing the exiting oil flow through flow channel 66 to a point beneath splash plate 98 and this diverts the spray of oil down and away from the spinning rotor hub 24 towards the drain opening 97. If, in an alternative design, the splash plate is not used, then the exiting oil needs to exit from a point lower than the lowest point of the base plate so that oil is not re-entrained on the surface of the spinning rotor as it flies radially outward from the exit point. As has been described, the "clean" process fluid then mixes with the driving fluid and drains out of the housing base 21 by way of drain opening 97 through the force of gravity.

Figure 6:
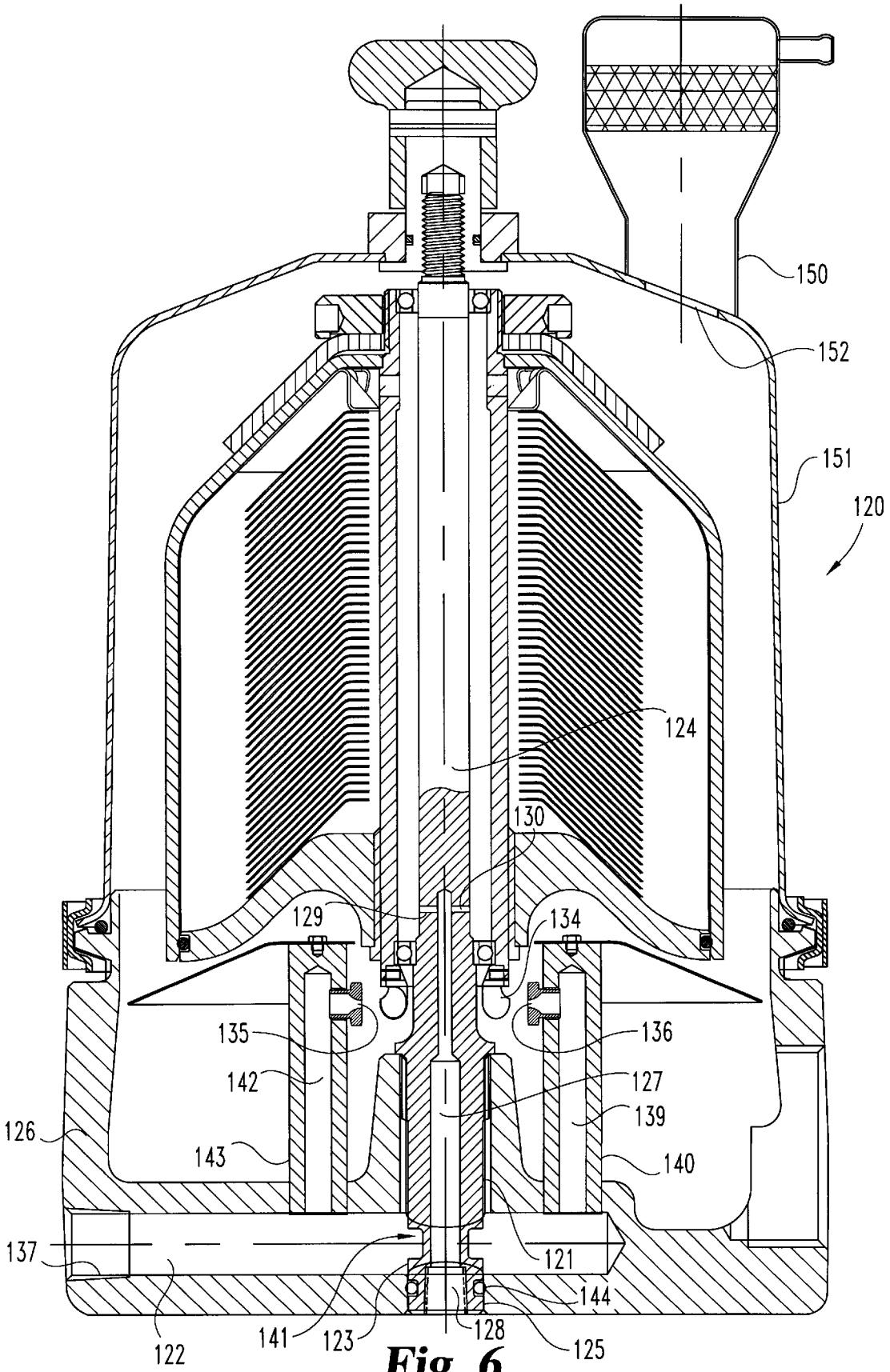
FIG. 6 is a front elevational view in full section of a cone-stack centrifuge according to an alternative embodiment of the present invention.
Figure 6A:
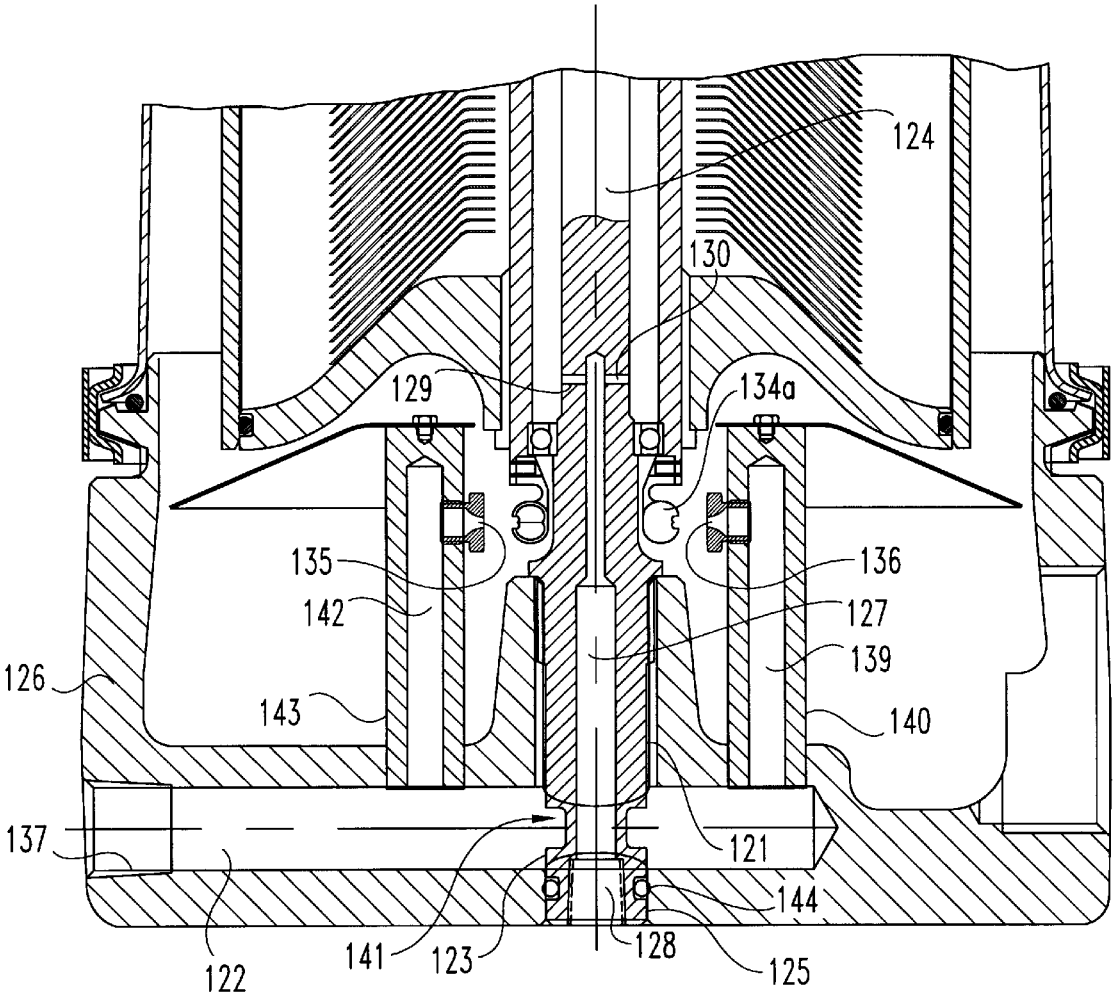
FIG. 6A is a partial, front elevational view in full section of a cone-stack centrifuge according to another embodiment of the present invention.
Figure 8:
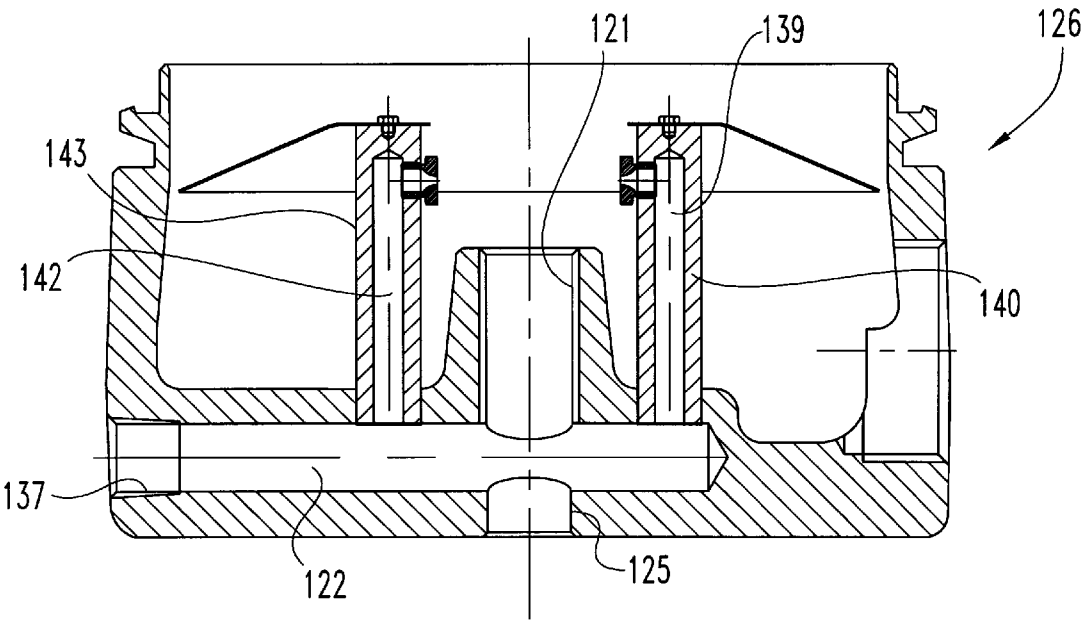
FIG. 8 is a front elevational view in full section of a base which comprises one part of the FIG. 6 cone-stack centrifuge.
Figure 7:
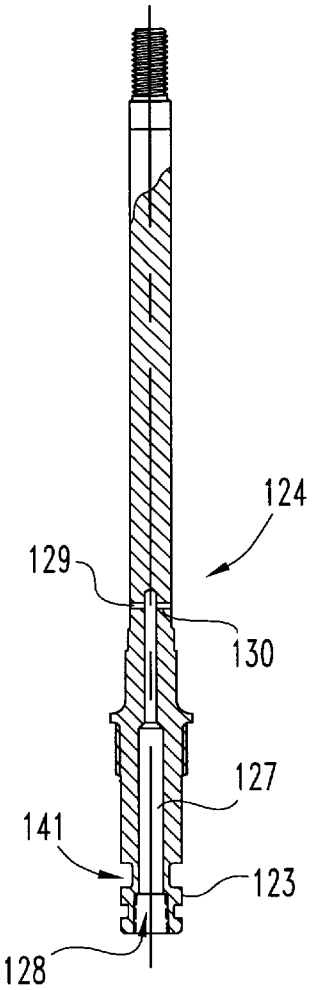
FIG. 7 is a front elevational view in full section of a center shaft which comprises one part of the FIG. 6 cone-stack centrifuge.

With reference to FIG. 6, an alternative cone stack centrifuge 120 is disclosed. It should be noted that centrifuge 120 has a structure which in many respects is quite similar to the cone-stack centrifuge 20 of FIG. 1. The principal differences between cone stack centrifuge 120 and cone-stack centrifuge 20 involve the designs and the relationships for the base 21, shaft 23, cylindrical aperture 89, and main passageway 83. Comparing these portions of centrifuge 20 with the corresponding portions of centrifuge 120 reveals the following differences. In the FIG. 1 design for centrifuge 20, the main passageway 83 is in direct flow communication with aperture 89 of base hub 87. As illustrated, the aperture 89 does not axially extend through the main passageway 83, but effectively is a T-intersection at that point. In the FIG. 6 design, there is no flow communication between cylindrical aperture 121 in the base and main passageway 122. Instead, the lower end or base 123 of the shaft 124 of centrifuge 120 is axially extended over that of base 90 such that shaft 124 extends through main passageway 122 and exits out through the lower aperture extension 125 of cylindrical aperture 121. Shaft 124 is illustrated in FIG. 7 as a separate component part. This lower aperture extension 125 intersects the main passageway 122 as is illustrated, and is axially aligned with the upper portion of cylindrical aperture 121 which is above the main passageway 122. The design of base 126 of centrifuge 120 is illustrated in FIG. 8. The base 123 of shaft 124 still includes a passageway 127 which provides a flow path from inlet aperture 128 to throttle passageways 129 and 130. Turbine 29 is now numbered as 134, but the designs are basically the same. In FIG. 6A, the alternative style of turbine with the split-bucket configuration is identified as turbine 134*a*.

It will be noted that shaft 23 includes a single throttle passageway 93 while shaft 124 (FIG. 6) includes two throttle passageways, 129 and 130. The reason for this is due to the fact that in the FIG. 6 embodiment, it is possible to throttle the incoming flow of oil at almost any point upstream from passageways 129 and 130, preferably outside of the centrifuge. As a result, passageways 129 and 130 do not have to serve as the sole throttling means. In FIG. 1, the incoming oil is also used to drive the turbine 29 and throttling the flow outside of the centrifuge would adversely affect the turbine speed. For this reason, throttling of the flow to the rotor 25 is accomplished by passageway 93. It is easier to accomplish the throttling function with one passageway as compared to two. For this reason, only a single passageway 93 is provided in the FIG. 1 embodiment.

Since the interior passageway 127 through the shaft is not in flow communication with main passageway 122, the incoming flow (oil) at inlet aperture 128 is not used to drive turbine 134. Turbine 134 is virtually identical to turbine 29 and the balance of centrifuge 120 is virtually identical to centrifuge 20, except as being described herein. In order to drive the turbine 134 by way of flow jet nozzles 135 and 136, a pressurized fluid is introduced into main passageway 122 by way of inlet aperture 137. In the preferred embodiment, this pressurized fluid (i.e., driving fluid) is a gas. The pressurized gas follows the same path as the oil in the FIG. 1 configuration except that the pressurized gas does not flow into passageway 127 and, as such, is not introduced into the cone-stack assembly 138.

In order for the pressurized gas to flow to passageway 139 in post 140 and ultimately to jet nozzle 136, the base 123 of shaft 124 is notched or indented at location 141 in order to permit the pressurized gas a free flow path around the base 123 of shaft 124. Passageway 142 in post 143 is in communication with passageway 122 for the delivery of the pressurized gas to jet nozzle 135. An O-ring 144 is positioned between base 123 and the lower aperture extension 125. Inlet aperture 128 is internally threaded for coupling the input conduit which delivers the fluid to be introduced into the cone-stack assembly.

The gas (typically air) which is used to drive the turbine 134 in FIG. 6 must be vented from the centrifuge 120 to the atmosphere. While a variety of vent designs and locations are suitable for this function, it is important to first separate any oil mist which may have co-mingled with the air. For this purpose, a coalescer 150 is attached to bell housing 151 and sealed around outlet 152. As the spray mist or aerosol of air and oil exits through outlet 152, the interior of the coalescer 150 pulls the oil out of the air. The air then passes to the atmosphere and the oil gradually drips back into the centrifuge. The interior of coalescer 150 includes a metal mesh or alternatively a woven or non- woven synthetic mesh, all of which are well known in the art.

Various styles or designs for turbine 29 and the corresponding buckets have been mentioned herein, including a classic Pelton turbine 29*a* with its split-bucket configuration for the individual buckets 32*a* (FIG. 1A) and a modified half-bucket style of turbine 29 with its buckets 32 (FIG. 1). Either style of impulse turbine is suitable for the FIG. 1 and FIG. 6 embodiments as well as for the alternative embodiments of FIGS. 1A and 6A. The diagrammatic illustration of FIG. 2 is intended to be a suitable generic representation of turbines 29 and 29*a*, even though numbered as turbine 29.

In the discussion of other options or variations for turbine 29, mention was made of a vane-ring or turgo style of turbine. While the individual vanes of such a turbine style can be placed at virtually any diameter, the efficiency with the gas-driven mode of operation is improved if the vane circle diameter is increased over the illustrated bucket circle diameter for turbine 29. The vane-ring style of turbine is preferred for gas-driven centrifuges. It is known that the optimal vane velocity is equal to one-half of the jet velocity and, based on choked flow (sonic velocity jet), it is preferable to locate the gas- driven vanes around a larger diameter.

Figure 9:
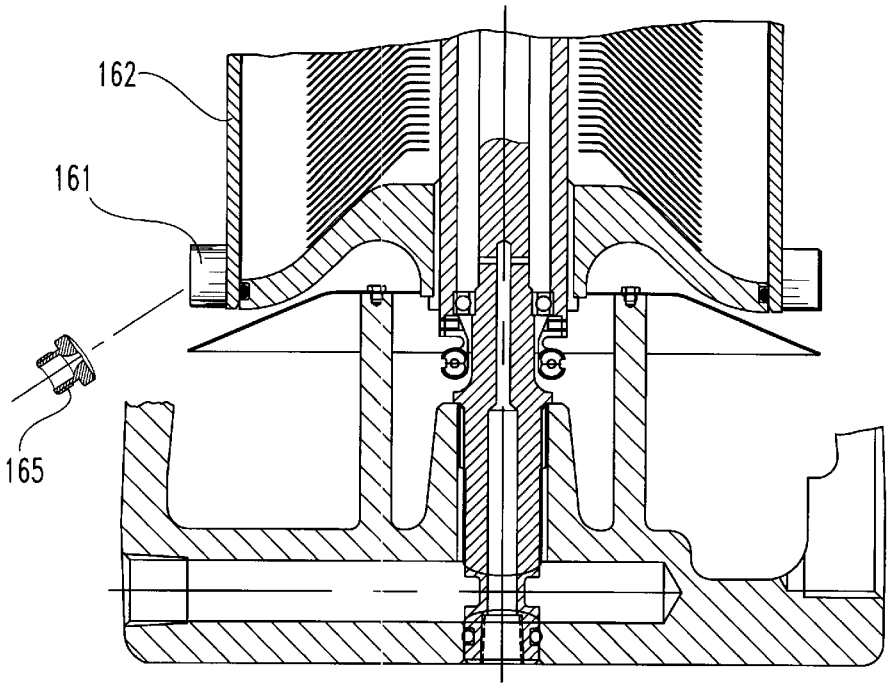
FIG. 9 is a partial, front elevational view in full section of a vane-ring style of impulse turbine suitable for use as part of the cone-stack centrifuge according to the present invention.
Figure 10:
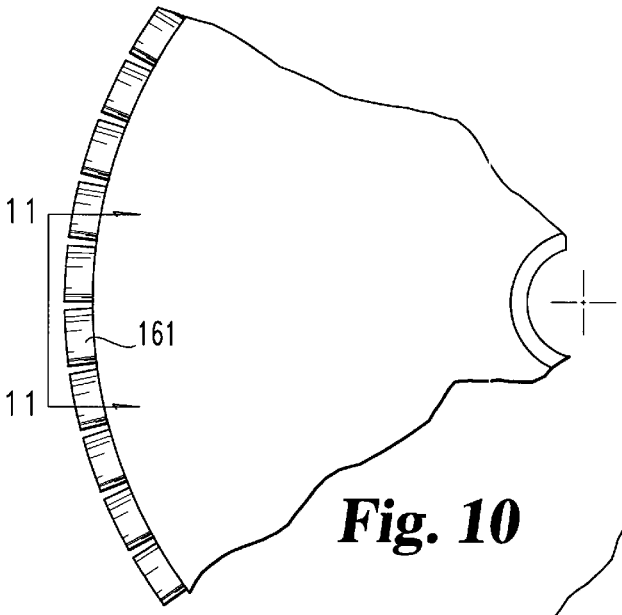
FIG. 10 is a partial, top plan view of the FIG. 9 vane-ring style turbine.
Figure 11:
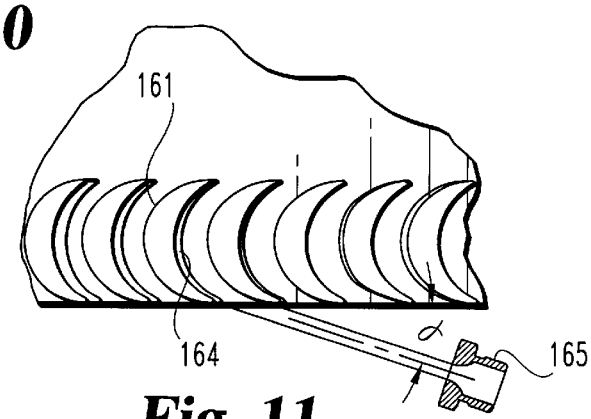
FIG. 11 is a diagrammatic illustration of one vane of the FIG. 9 vane-ring style turbine and cooperating nozzle jet.

Accordingly, FIGS. 9–11 illustrate a vane-ring turbine 160 which is created by the attachment of individual vanes 161 to the outer surface of the generally cylindrical portion 162*a* of the rotor shell 162 which is adjacent the lower edge 163. Each vane 161 has a curved form with a concave impingement surface 164. With this type of vane, the jet nozzle 165 is directed at an angle of between 5 and 20 degrees relative to the vane centerline, an angle which generally coincides with the leading edge angle of the vane 61. The jet nozzle 165 delivers a jet of air from passageway 166 which strikes the vanes in rotary sequence and thus drives (rotates) the rotor which is bearingly mounted onto the shaft.

For gas-driven operation of the centrifuge of FIGS. 6, 6A, and 9, the gas jet is at sonic velocity (for pressures above approximately 13 psig). The optimal vane velocity (FIG. 9) for maximum kinetic energy extraction is about 0.4 times the jet velocity, which would be about 440 feet per second (for a sonic velocity of 1100 feet per second). At 10,000 RMP with a 7.3 inch diameter rotor, the vane velocity (with the vanes 161 located at the perimeter illustrated in FIG. 9) is approximately 320 feet per second which is still "slow" relative to optimal.

The vane (vane-ring) style of turbine used for the FIG. 9 centrifuge can be used with the centrifuge embodiments of FIGS. 1, 1A, 6, and 6A as a replacement for the modified half-bucket and split-bucket turbine styles. There are though efficiency differences based on the turbine style which is used, the location of the turbine, the rotor diameter, the driving medium, and the jet velocity.

Figure 12:
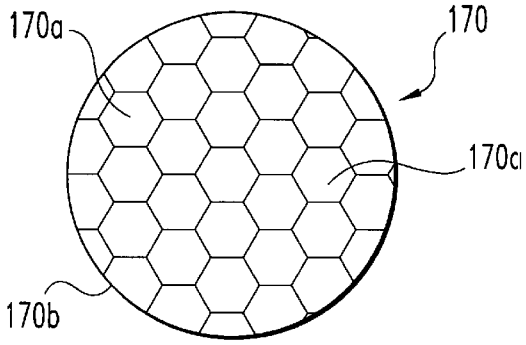
FIG. 12 is an end elevational view of a jet nozzle insert for use as part of the cone-stack centrifuge according to the present invention.

In accordance with another embodiment of the present invention, the stationary jet nozzles 27 and 28 of FIG. 1 and the stationary jet nozzles 135 and 136 of FIG. 6 are modified by positioning a honeycomb-like insert 170 (see FIG. 12) in the inlet of each jet nozzle. Each of the individual flow apertures 170*a* is defined by a hexagonally-shaped outer wall and extends the entire length of insert 170. The function of insert 170 is to straighten the flow by removing or lessening the inlet turbulence. As a result of using insert 170, there is a noticeable improvement in the coherency and stability of the jet stream that exits the nozzle and which is directed at the turbine. This honeycomb-like insert 170 may also be used in conjunction with jet nozzle 165, if inlet turbulence is a concern.

Figure 14:
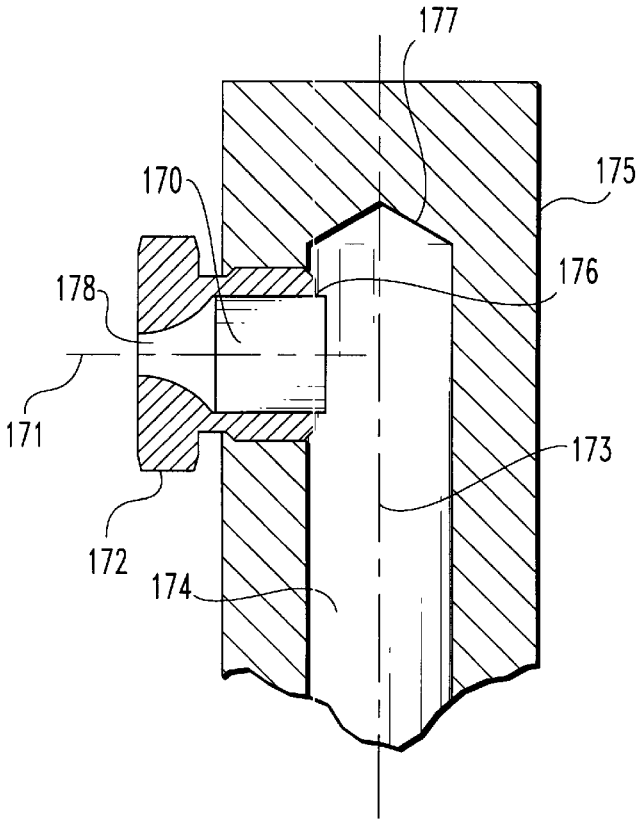
FIG. 14 is a front elevational view in full section of a representative mounting post and jet nozzle incorporating the FIG. 12 jet nozzle insert.

With continued reference to FIGS. 1 and 6, the corresponding stationary jet nozzles 27 and 28 and 135 and 136, respectively, are positioned and assembled to corresponding mounting posts (86, 88, 140, and 143). Each mounting post defines an interior flow passageway which communicates with the inlet of its corresponding jet nozzle. FIG. 14 provides a generic illustration of a representative jet nozzle and mounting post assembly for the purpose of describing the inlet turbulence and the positioning and functioning of insert 170.

With continued reference to FIG. 14, the central flow axis 171 of representative jet nozzle 172 is generally perpendicular to the central flow axis 173 of flow passageway 174 in mounting post 175. In effect the flow from passageway 174 to nozzle inlet 176 necessitates a right angle turn. Whatever turbulence this might create is compounded by the nature of the closed end 177 of mounting post 175 and any reverse flow coming back toward inlet 176.

When there is flow turbulence at the inlet 176 of the jet nozzle 172 (caused in part by the 90 degree bend of the flow), there is a break up of the exiting flow stream prior to impact with the turbine buckets (see FIGS. 1 and 6). When the exiting flow stream or jet breaks up prior to impact with the turbine buckets, the turbine efficiency decreases. A less efficient turbine can result in a lower turbine speed than what is desired for this particular application or an increase in lube oil pumping and power consumption in order to try and maintain the desired speed.

It has been learned that one of the key factors contributing to optimal impulse turbine efficiency is having a stable, coherent liquid jet exiting from each jet nozzle as it impacts the turbine buckets. When there is break up of the exiting flow stream, seen as droplets and as a fanning out pattern immediately upon exit from the jet nozzle, there is a very poor jet quality and an inefficient turbine. A designed thermodynamic efficiency of 50 to 60 percent can drop to as low as 25 to 35 percent due to the break up of the exiting flow stream.

By means of the honeycomb-like insert 170 there is an improvement in the turbine efficiency due to the improved coherency and stability of the liquid jet which is directed at the turbine buckets. The insert 170 redirects the flow at inlet 176 so as to straighten it in the direction of the tapered outlet 178 of jet nozzle 172. This in turn creates more laminar entrance conditions at the nozzle throat, resulting in a coherent, stable exiting jet. This improvement results in a substantial turbine efficiency gain which allows the centrifuge to achieve the desired speed with lower power consumption and lube-oil pumping.

Insert 170 is fabricated from a relatively thin section of aluminum foil having a thickness of approximately 8.9 mm (0.35 inches). Each individual cell 170*a* (hexagonal aperture) measures approximately 1.09 mm (0.043 inches) across opposite flat sides. The length of insert 170 is such that it is fully inserted into nozzle 172 up to the location of the throat where the inlet opening begins to taper. The opposite end of the insert 170 extends beyond the end of nozzle 172 into the interior of passageway 174 as illustrated in FIG. 14. The outside diameter size of surface 170*b* of insert 170 measures approximately 6.35 mm (0.25 inches) and is sized to fit closely in the jet nozzle inlet 176.

Figure 13:
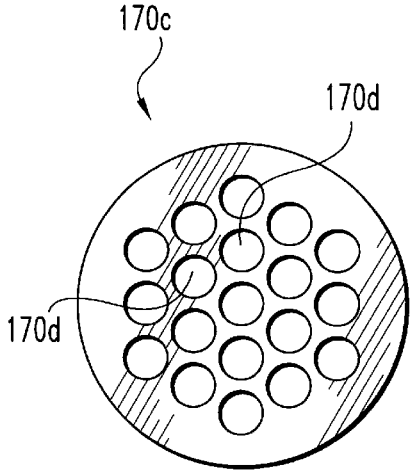
FIG. 13 is an end elevational view of an alternative jet nozzle insert for use as part of the cone-stack centrifuge according to the present invention.

Options for insert 170 include the use of a molded plastic (see FIG. 13) or a die-cast metal such as Zn, Mg, or Al. These alternative materials would still produce an insert 170*c* with the described long and narrow capillary tube-like (cylindrical) passages 170*d* in order to create the desired laminar flow. Each passage 170*d* measures approximately 0.86 mm (0.034 inches) in diameter.

Other options for insert 170 include the use of a very coarse sintered-metal plug or a woven, wire-mesh disk attached over the nozzle inlet 176. However, these options have an associated higher pressure drop which is not desired, even though they would still reduce turbulence at the nozzle inlet 176.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cone-stack centrifuge for separating particulate matter out of a circulating fluid, said centrifuge comprising:

a rotor including a cone stack and a hollow rotor hub constructed and arranged to rotate about an axis;

a base assembly defining a fluid inlet, a first passageway, a second passageway connected to said first passageway and a hollow base hub, said fluid inlet being connected to said hollow base hub by said first passageway;

a shaft centertube attached to said base hub and extending through said rotor hub, said shaft centertube having a passageway therein for delivering said fluid from said first passageway to said cone stack;

a bearing positioned between said rotor hub and said shaft centertube for rotary motion of said rotor about said shaft centertube;

an impulse turbine attached to said rotor;

a flow jet nozzle flow coupled to said second passageway and being constructed and arranged for directing a flow jet of said fluid at said impulse turbine which in turn imparts rotary motion to said rotor; and a flow-directing insert assembled into said flow jet nozzle for reducing inlet turbulence.

2. The cone-stack centrifuge of claim 1 wherein said impulse turbine includes a plurality of individual turbine buckets, each with a half-bucket design, which are constructed and arranged to be acted upon by said flow jet of said fluid.

3. The cone-stack centrifuge of claim 2 wherein said flow-directing insert defines a plurality of spaced-apart flow apertures.

4. The cone-stack centrifuge of claim 1 wherein said impulse turbine includes a plurality of individual turbine buckets, each with a split-bucket design, which are constructed and arranged to be acted upon by said flow jet of said fluid.

5. The cone-stack centrifuge of claim 4 wherein said flow-directing insert defines a plurality of spaced-apart flow apertures.

* * * * *

UNITED STATES PATENT AND TRADEMARK OFFICE
CERTIFICATE OF CORRECTION

PATENT NO : 6,019,717

DATED : February 1, 2000

INVENTOR(S) : Peter K. Herman

It is certified that error appears in the above-identified patent and that said Letters Patent is hereby corrected as shown below:

In Col. 1, at line 27, replace "fill" with -- full -- .

Signed and Sealed this

Fourteenth Day of November, 2000

*Attest:*

Q. TODD DICKINSON

*Attesting Officer*

*Director of Patents and Trademarks*